US005366382A

United States Patent [19]

Thumma

[11] Patent Number: 5,366,382

[45] Date of Patent: Nov. 22, 1994

[54] ELECTRICAL CONNECTOR WITH SHORTING CONTACTS

[75] Inventor: Mark R. Thumma, Oberlin, Pa.

[73] Assignee: The Whitaker Corporation, Wilmington, Del.

[21] Appl. No.: 152,808

[22] Filed: Nov. 15, 1993

Related U.S. Application Data

[63] Continuation-in-part of Ser. No. 6,069, Jan. 15, 1993, Pat. No. 5,277,607.

[51] Int. Cl.[5] ..... H01R 23/68

[52] U.S. Cl. ..... 439/188; 439/637

[58] Field of Search ..... 439/188, 513, 59, 60, 439/62, 629, 630, 636, 637; 200/51.09, 51.1

[56] References Cited

U.S. PATENT DOCUMENTS

| | | | |
|---|---|---|---|
| 3,627,929 | 12/1971 | Gilissen et al. | 439/188 |
| 3,976,850 | 8/1976 | Faber et al. | 200/51.1 |
| 4,087,151 | 5/1978 | Robert et al. | 439/188 |
| 4,106,841 | 8/1978 | Vladic | 439/188 |
| 4,285,565 | 8/1981 | Kirby | 439/637 |
| 4,514,030 | 4/1985 | Triner et al. | 439/188 |
| 4,647,140 | 3/1987 | Crawford | 439/629 |
| 5,098,306 | 3/1992 | Noschese et al. | 439/188 |

FOREIGN PATENT DOCUMENTS

| | | |
|---|---|---|
| 2802800 | 1/1978 | Germany . |
| 2133938 | 8/1984 | United Kingdom . |
| 8504528 | 10/1985 | WIPO . |

*Primary Examiner*—Gary F. Paumen

*Attorney, Agent, or Firm*—Katherine A. Nelson

[57] ABSTRACT

A pair of shorting contacts (116,116) on mated electrical terminal members (110,110). The shorting contacts are edges of angled surfaces (36) on the respective electrical terminal members which are laterally reversed mirror images of each other. The respective edges confront each other in a substantially transverse configuration. Initial engagement between the respective edges is at an initial point contact (125) at a high stress. The edges thereafter wipe against one another and come to engage at a final point contact. The path from the initial point contact to the final point contact constitutes a line between the respective electrical terminal members.

3 Claims, 13 Drawing Sheets

ELECTRICAL CONNECTOR WITH SHORTING CONTACTS

RELATED APPLICATION

This application is a continuation-in-part of U.S. patent application Ser. No. 08/006,069, filed Jan. 15, 1993, now U.S. Pat. No. 5,277,607 issued Jan. 11, 1994.

FIELD OF THE INVENTION

The present invention relates to shorting electrical contacts for a printed circuit board connector and more particularly to contacts that wipe against one another and engage one another at a final point contact.

BACKGROUND OF THE INVENTION

A mother board and one or more daughter boards are used to transfer signals between respective assemblies used in a computer or other electronic equipment. The mother and daughter boards may be arranged perpendicular to each other, as in an "edge card" configuration, depending upon the design of the overall product.

Edge card connector contacts are formed on the mother card so that when the daughter card is removed, the opposing contacts come together to form an electrical shorting circuit. The reliability of these shorting contacts is very important to the efficiency of the overall equipment. Due to the environment in which the boards are located, there is the possibility of debris being collected at the interface between the mother board and the daughter board or of a film being formed on the opposing contacts on the mother card. In this type of situation, the electrical connection between the opposing contacts may be imperfect or unreliable and may result in malfunction of the electronic equipment.

The following citations reflect the state of the art of which the applicant is aware insofar as these citations appear relevant to the present invention.

| U.S. Pat. No. | Inventor(s) | Issue Date |
|---|---|---|
| 3,627,929 | Gilissen et al | 12/14/71 |
| 3,976,850 | Faber et al | 08/24/76 |
| 4,087,151 | Robert et al | 05/02/78 |
| 4,106,841 | Vladic | 08/15/78 |
| 4,285,565 | Kirby | 08/25/81 |
| 4,514,030 | Triner et al | 04/30/85 |
| 4,647,100 | Crawford | 03/31,87 |
| 5,098,306 | Noschese et al | 03/24/92 |

| Other Patent No. | Issue Date |
|---|---|
| German 28 02 800 | 07/27/78 |
| UK 2 133 938 | 08/01/84 |
| PCT W085/04528 | 10/10/85 |

The known art utilizes opposing contacts which are usually bent or bowed members, parallel to one another which engage across the entire width of the respective contacts. Alternately a dimple has been used on a surface to obtain contact stress against the opposing contact.

It is important to have opposing contacts which can reliably and simply effect an electrical connection when the daughter board is removed from the mother board and which can overcome film deposits and debris on the surfaces of the contacts.

SUMMARY OF THE INVENTION

The present invention provides a reliable shorting circuit on the mother board by a high stress contact wherein the contacts are transverse to one another and wipe against one another before engaging at a final contact point.

In accordance with the teachings of the present invention, there is disclosed herein an electrical assembly, which includes a printed circuit board alternately inserted and withdrawn between a pair of shorting contacts. The shorting contacts confront each other and are laterally-reversed mirror images of each other. Means are provided on each of the shorting contacts to assure an initial point contact therebetween. After the initial point contact, the shorting contacts wipe against each other and come to engage each other at a final point contact. The path from the initial point contact to the final point contact constitutes a line between the respective shorting contacts.

In one embodiment, the pair of shorting contacts for printed circuit board connector includes a pair of terminal members, each of which has a longitudinal axis. A protrusion is formed on the leading end of each of the terminal members. Each protrusion is substantially bisected frustum conical in shape. Each protrusion has a respective base and a respective top. Each protrusion is formed at an acute angle with respect to the longitudinal axis of the respective terminal member. The terminal members are in a side-by-side relationship so that their respective angled protrusions confront one another substantially in a transverse configuration. In this manner, the base of each protrusion is opposite the top of each confronting protrusion so that the respective sides of the confronting protrusions on the terminal members initially engage each other at an initial point contact. A very high stress concentration is provided therebetween. The terminal members thereafter wipe against each other and come to engage each other at a final point contact. The path from the initial point contact to the final point contact constitutes a line between the respective terminal members.

In another preferred embodiment, a radiused protrusion is formed on the leading end of each of the terminal members. The radiused protrusion is formed at an acute angle with respect to the longitudinal axis of the respective terminal member. The terminal members are in a side-by-side relationship so that their respective angled radiused protrusions confront one another substantially in a transverse configuration. The respective terminal members are twisted so that the terminal members initially engage each other at an initial point contact, thereby providing a very high stress concentration therebetween. The terminal members thereafter wipe against each other and come to engage each other at a final point contact. The path from the initial point contact to the final point contact constitutes a line between the respective terminal members.

In a further alternative embodiment, the leading ends of the terminal members are stamped or cut at an acute angle with respect to the longitudinal axis of the terminal member thereby providing shorting contacts at an edge of the angled surface. The terminal members are in a side-by-side relationship so that their respective angled edges confront one another substantially in a transverse configuration. A very high stress concentration is provided between the edges where the two angled ends touch one another. The terminal members thereafter wipe against each other and come to engage each other at a final point contact. The path from the initial point contact to the final point contact constitutes a line between angled edges of the respective terminal members.

These and other objects of the present invention will become apparent from a reading of the following specification, taken in conjunction with the enclosed drawings.

DETAILED DESCRIPTION OF THE PREFERRED EMBODIMENTS

Figure 1:
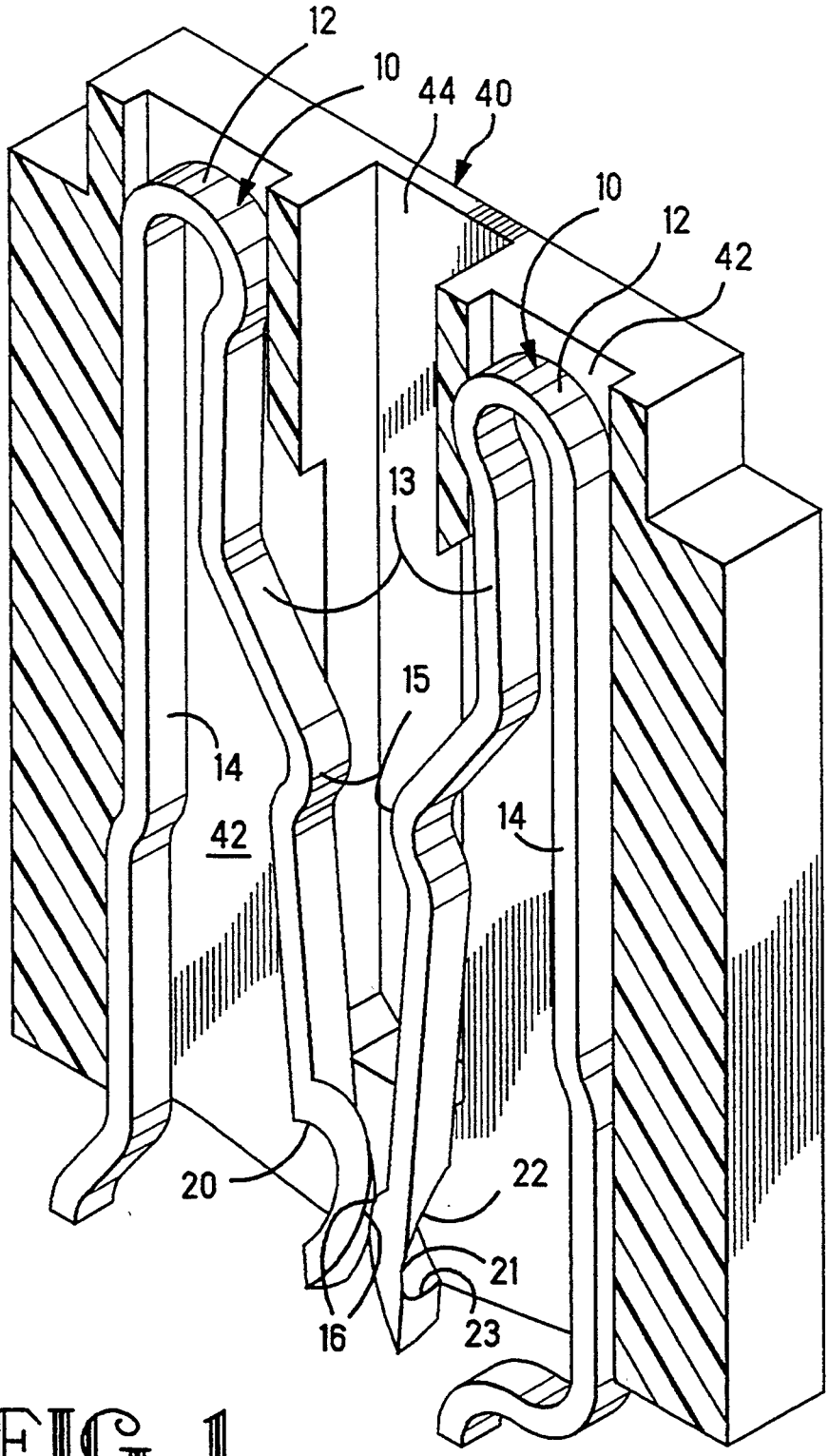
FIG. 1 is a perspective view of a mated pair of electrical terminal members showing the shorting contacts of the present invention.
Figure 2:
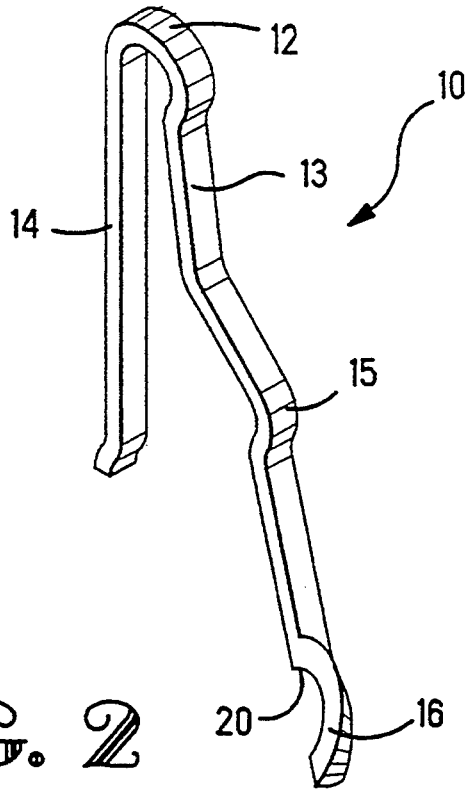
FIG. 2 is a perspective view of one electrical terminal member showing the right side of the shorting contact.
Figure 3:
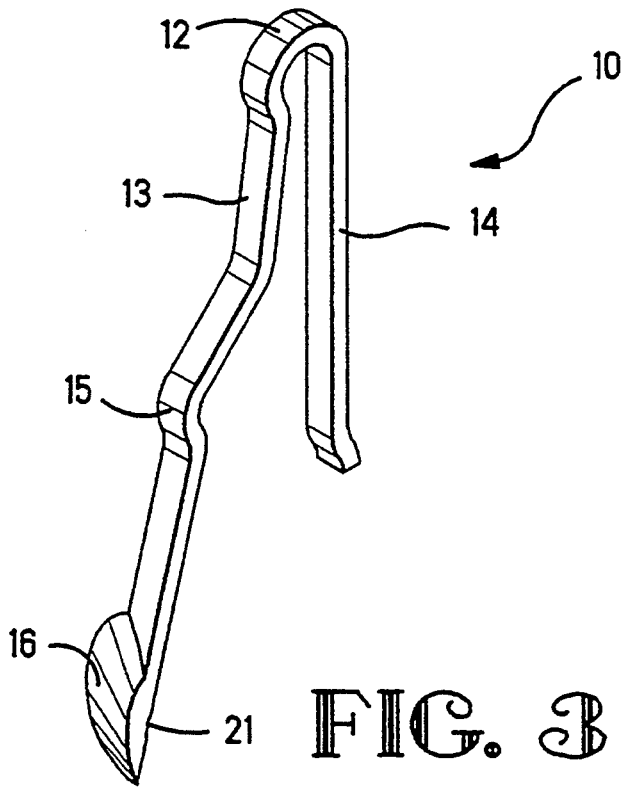
FIG. 3 is a perspective view of the electrical terminal member of FIG. 2 showing the left side of the shorting contact.
Figure 4:
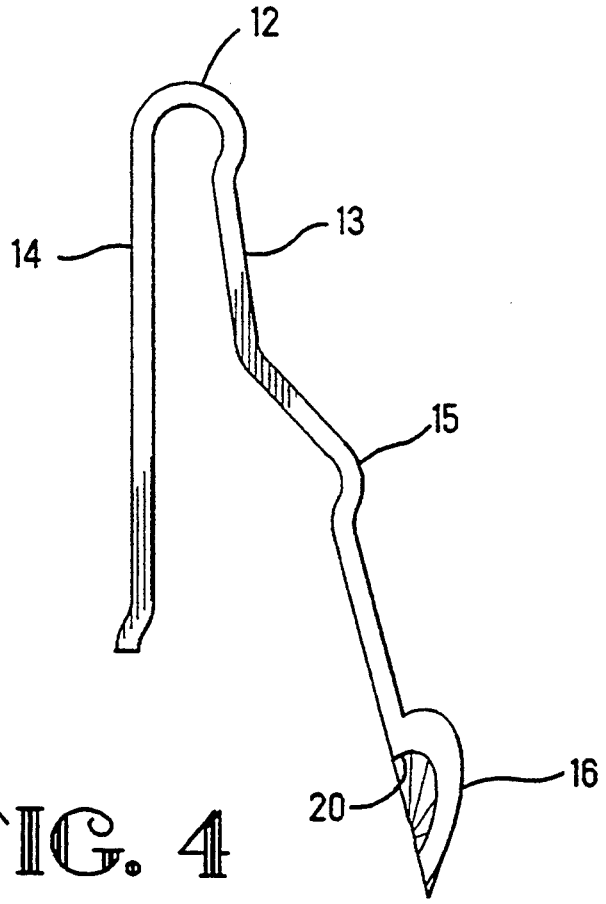
FIG. 4 is a side view of the electrical terminal member of FIG. 2.
Figure 5:
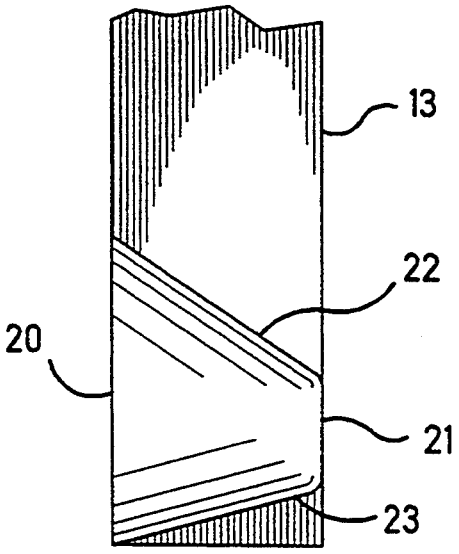
FIG. 5 is a partial front view of the electrical terminal member of FIG. 2 showing the shorting contact.
Figure 6A:
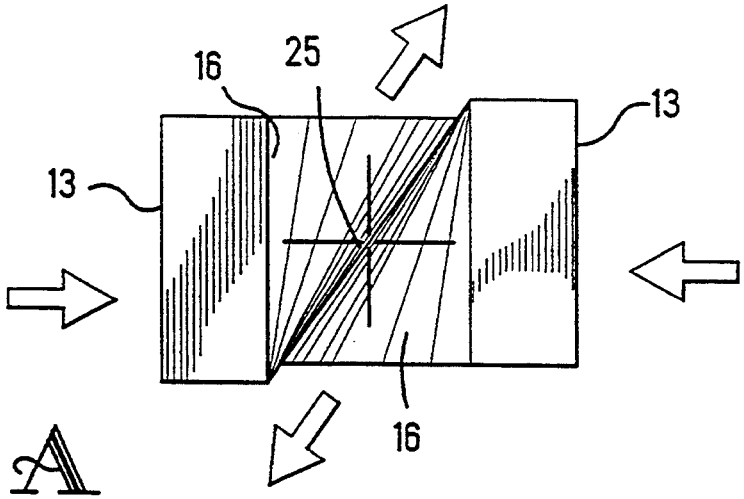
FIGS. 6A–6B are end views of the mated pair of electrical terminal members of FIG. 1 showing the wiping movement of shorting contacts.
Figure 6B:
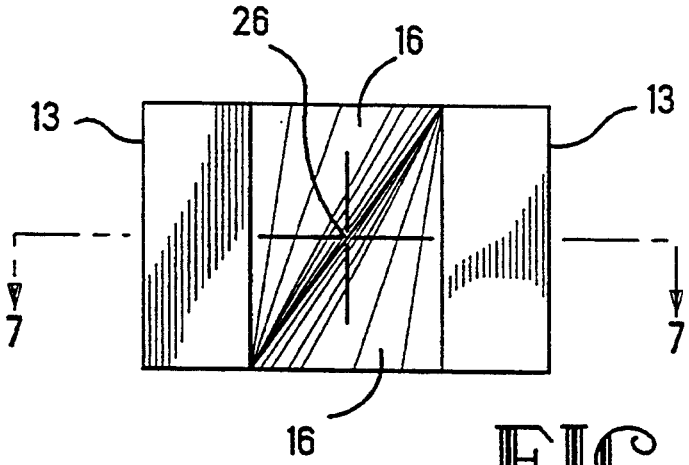
Figure 7:
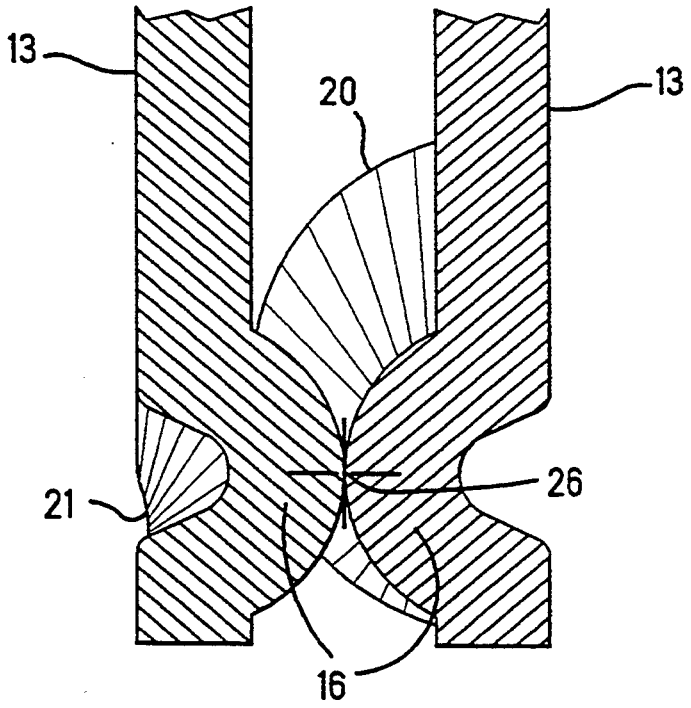
FIG. 7 is a cross section view taken across the lines 7—7 of FIG. 6B.

With reference to FIG. 1–8, a first embodiment of the present invention is shown. A plurality of electrical terminal members 10 secured to a mother board 11, as shown in FIGS. 8A and 8B. The electrical terminal member 10 is made from electrically conductive material (preferably beryllium copper) formed with a U-shaped bend 12 at the upper end, a front leg 13, a rear leg 14, an upper board contact 15 at the approximate midpoint of the front leg 13 and a shorting contact 16 at the lower end of the front leg 13. The bent configuration of the electrical terminal member 10 provides a resiliency to the electrical terminal member 10 so that the shorting contact 16 is biased in a direction away from the rear leg 14.

Figure 8B:
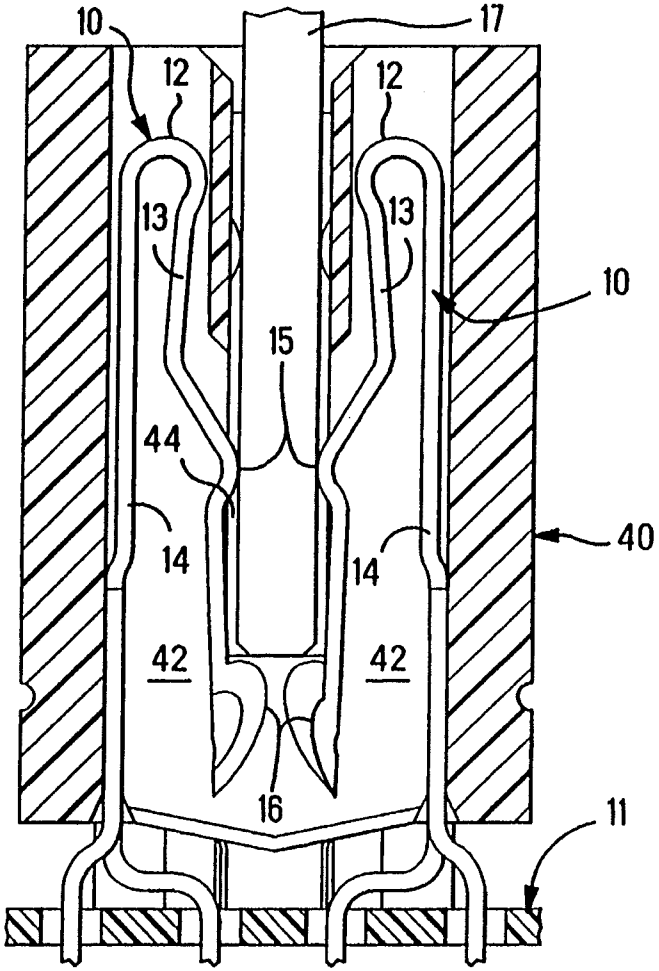
FIGS. 8A–8B are cross section views showing the insertion of a daughter board between the mated electrical terminal members.
Figure 8A:
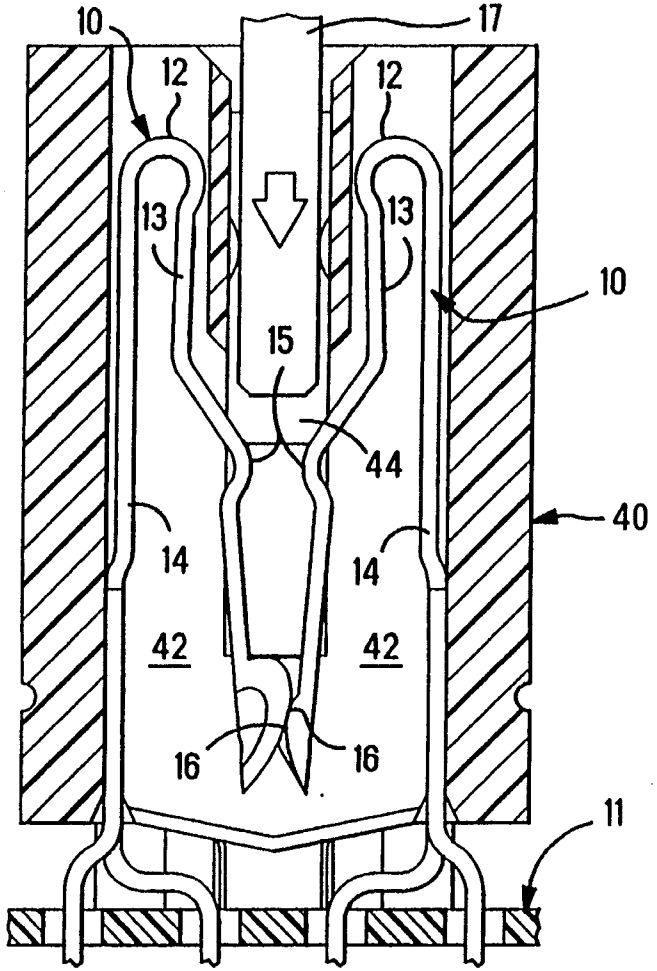

Preferably the electrical terminal men%hers 10 are secured in cavities 42 of a dielectric housing 40 in mating opposing pairs wherein the respective upper contacts 15 and shorting contacts 16 are facing the corresponding contacts on the opposing electrical terminal member 10. In the normal condition, the respective upper contacts 15 of the opposing front legs 13 are spaced apart and the respective shorting contacts 16 of the opposing electrical terminal members 10 are touching one another to provide an electrical connection (a shorting connection) between the mated electrical terminal members 10. A daughter board 17 having an electrical circuit thereon may be inserted in a slot 44 in housing 40 between the mated electrical terminal members 10, as shown in FIGS. 8A and 8B. The daughter board 17 initially makes electrical contact with the upper contacts 15 on the respective mating electrical terminal members 10. As the daughter board 17 is further inserted, the opposing shorting contacts 16 are separated. Upon removal of the daughter board 17 from between the mated electrical terminal members 10, the opposing shorting contacts 16 are urged together due to the resiliency of the respective connecting bodies 10 and a shorting type electrical connection is effected between the mated connecting bodies 10.

The present invention is directed toward the shorting contacts 16 to assure a high reliability electrical connection. The development of a film such as an oxide or the deposition of debris such as dust on the engaging surfaces of the respective shorting contacts 16 are common causes of poor electrical contact. The present invention overcomes these problems.

In one preferred embodiment, the shorting contact 16 is a protrusion 16 formed on the longitudinal axis of the terminal member. The protrusion 16 is in the shape of a bisected frustum cone having a base 20, a top 21, an upper side 22 and a lower side 23. The altitude of the protrusion 16 is between the base 20 and the top 21 and is also perpendicular to the longitudinal axis of the front leg 13. The upper side 22 is disposed at an angle of approximately 30°–60° with respect to the altitude of the protrusion 16 with a particularly preferred disposition of approximately 45°. The lower side 23 is disposed at an angle of approximately 0°–45° with respect to the altitude of the protrusion 16. In this manner, both sides 23, 24 of the protrusion 16 are disposed at an acute angle with respect to the longitudinal axis of the front leg 13.

The respective protrusions 16 on the mated electrical terminal members 10 are laterally-reversed mirror images of one another. In this manner, the base 20 of the protrusion 16 on one electrical terminal member 10 is disposed opposite the top 21 of the protrusion 16 on the mated electrical terminal member 10 and the respective protrusions 16 confront one another in a transverse configuration.

As the respective protrusions 16 initially contact one another there is an initial contact point 25 on the curved edge of each respective protrusion 16. Due to the resiliency of the electrical terminal members 10, and there being only a point contact between the electrical terminal members 10, the contact point 25 is under high stress. Also due to such resiliency and the arcuate nature of the contacting edges of the respective protrusions 16, the protrusions 16 wipe against one another in a sliding movement and come to engage one another at a final contact point 26, the path between the initial contact point 25 and the final contact point 26 constituting a line. When the mated electrical terminal members 10 are viewed from the end and as the daughter board 17 is inserted between the terminal men, hers 10, the shorting contacts 16 move slightly sideways with respect to one another and then outwardly from one another in a letter "L" like movement.

Figure 9:
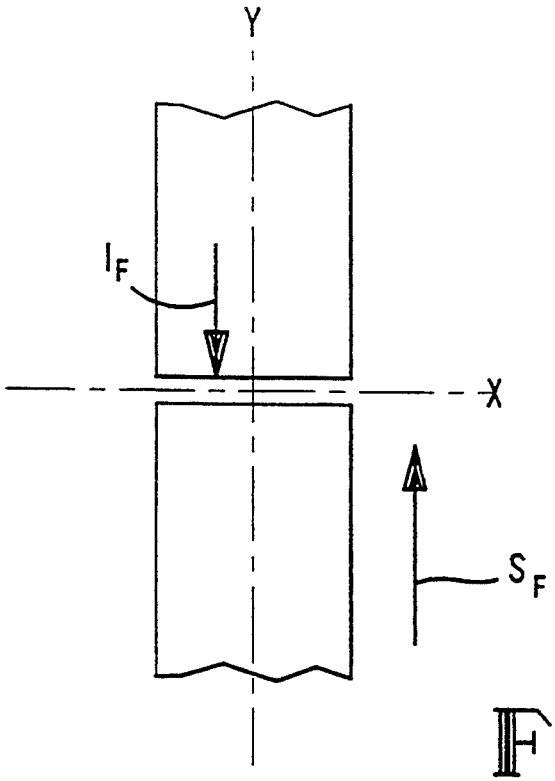
FIG. 9 is a sketch showing contacting edges being substantially parallel to one another and the forces attendant thereto.
Figure 10:
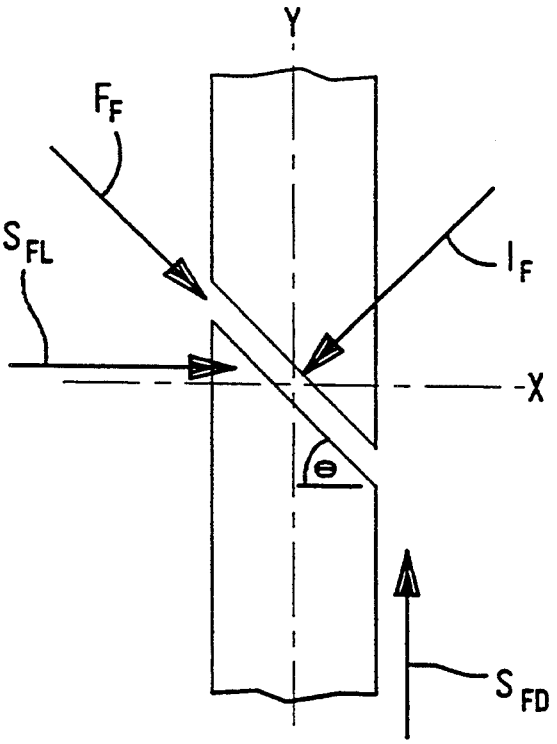
FIG. 10 is a sketch showing contacting edges meeting at an angle with the forces attendant thereto.

The advantage of having the contact surfaces at an angle with respect to one another is further shown in FIGS. 9 and 10. FIG. 9 shows the contacting edges being substantially parallel to one another as is common practice in the field. In this situation the spring force ($S_F$) is equal and opposite to the contact interface force. However, when the opposing contacts meet at an angle with respect to one another (FIG. 10) the interface force ($I_F$) is greater than the direct spring force ($S_{FD}$). To illustrate, $S_{FD}$ is spring force direct, $F_F$ is friction force, $S_{FL}$ is spring force lateral, $I_F$ is interface force. Let $F_X$=any force component acting along X axis $F_Y$=any force component acting along Y axis Then, for system in static equilibrium: $\Sigma F_X=0$ and $\Sigma F_Y=0$ As a reasonable example assume:

spring force direct $S_{FD}=50$ grams interface angle $\theta=45°$ coefficient of friction $\mu=0.2$ Then $$\Sigma F_Y=S_{FD}-F_{F\,sin\,\theta}-I_F\cos\theta=0$$

Where $$F_F=\mu\, I_F$$

$$S_{FD}-\mu\, I_F\sin\theta-I_F\cos\theta-0$$

$$50-0.2\, I_F\sin 45°-I_F\cos 45°=0$$

$$50-0.1414\, I_F-0.707\, I_F=0$$

$$50-0.8485\, I_F=0$$

$I_F=58.9$ grams, this is higher than $S_{FD}$

Also $$\Sigma F_X=0$$

$$\Sigma F_X=S_{FL}+F_F\cos\theta-I_F\sin\theta=0$$

$$S_{FL}\mu\, I_F\cos\theta-I_F\sin\theta=0$$

$$S_{FL}+0.2\,(58.9)\cos 45\ -58.9\sin 45=0$$

$$S_{FL}+8.3-41.6=0$$

$S_{FL}=33.3$ grams

As shown, the interface force is greater than the spring force. This can be viewed as a wedge effect. An increase in the force at the interface further increases the surface stress.

Thus, the wiping movement between the respective protrusions consists of a moving point of contact which effectively overcomes any film or debris on the respective shorting contacts 16 and provides a highly reliable electrical contact.

Figure 11:
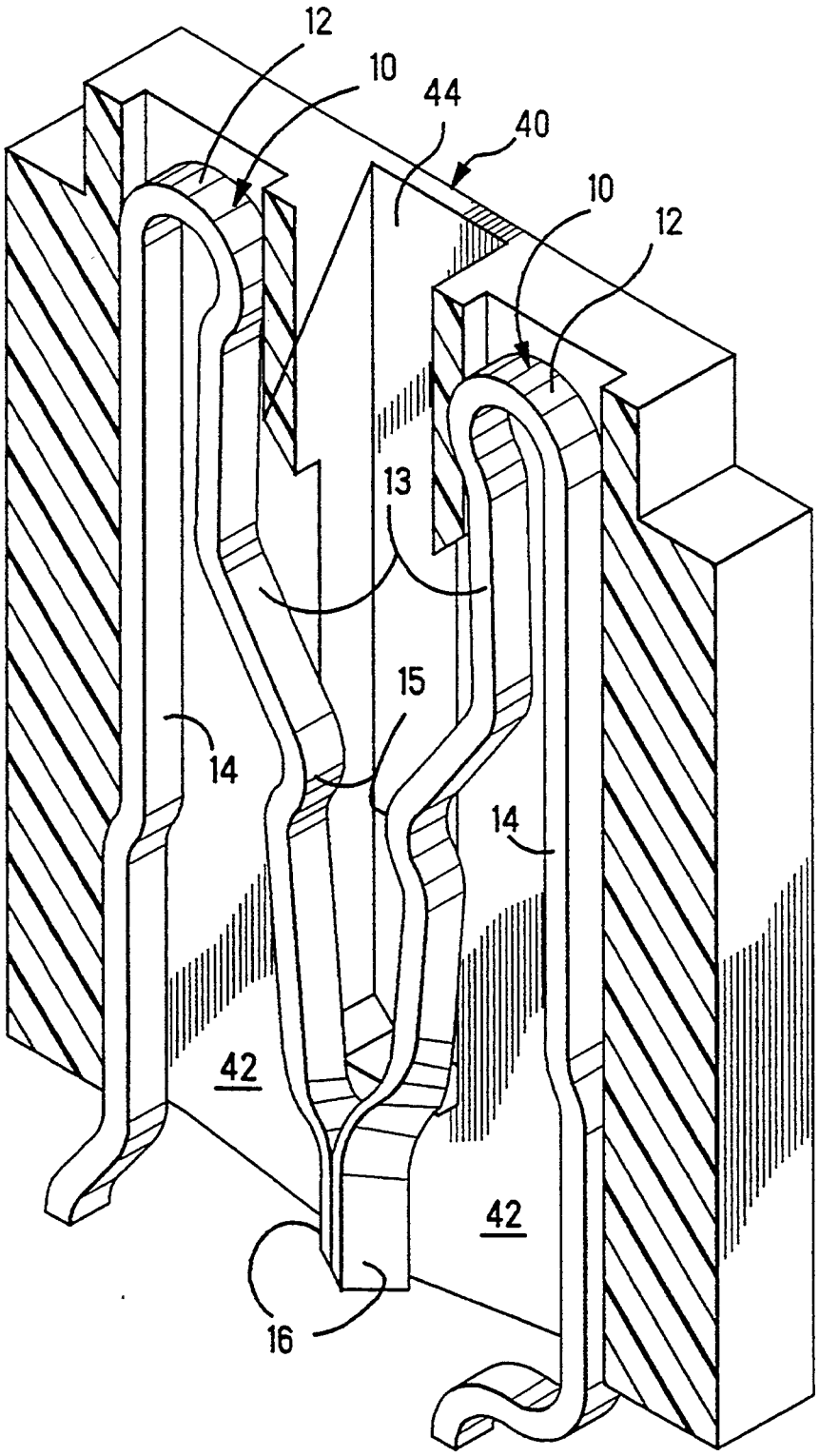
FIG. 11 is a perspective view of a mated pair of electrical terminal members showing the shorting contacts of another embodiment of the present invention.
Figure 12A:
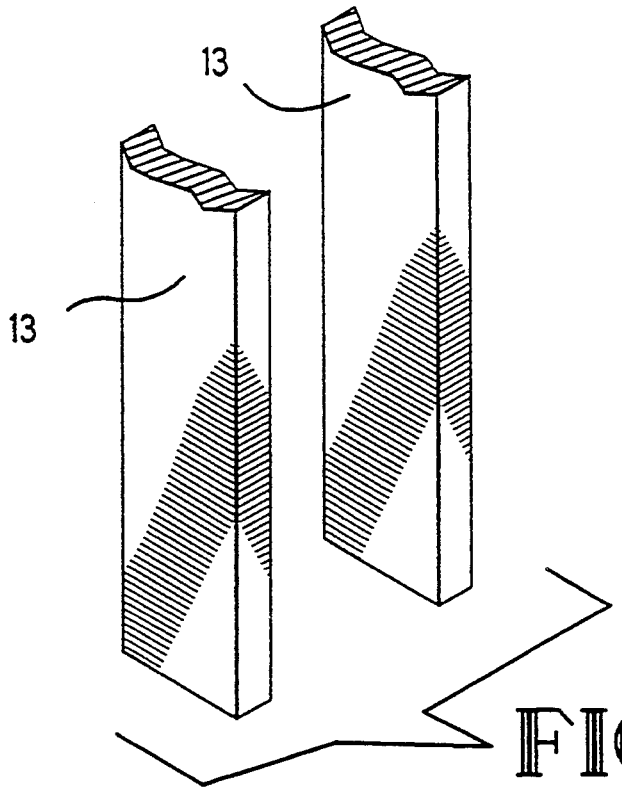
FIGS. 12A–12D are perspective views of the embodiment of FIG. 11 showing the forming of the shorting contacts.
Figure 12B:
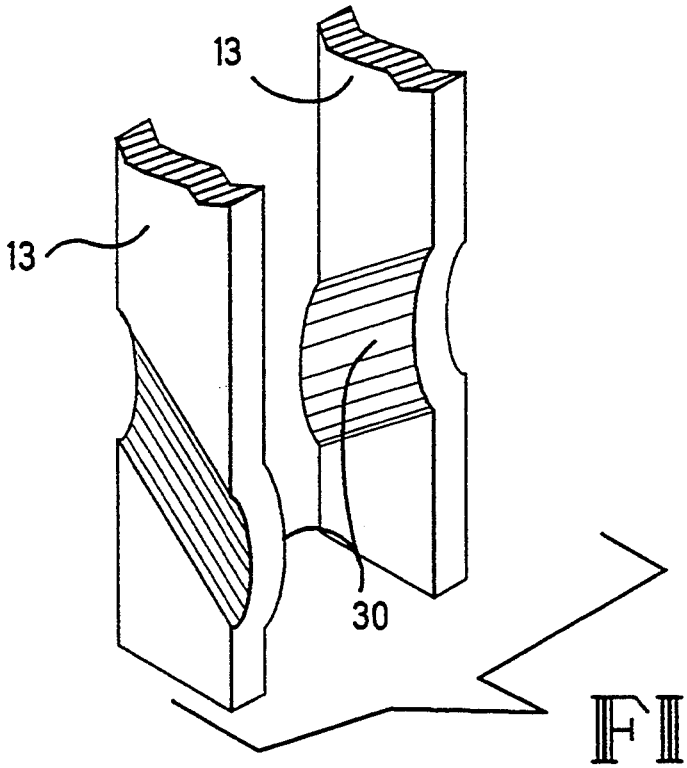
Figure 12C:
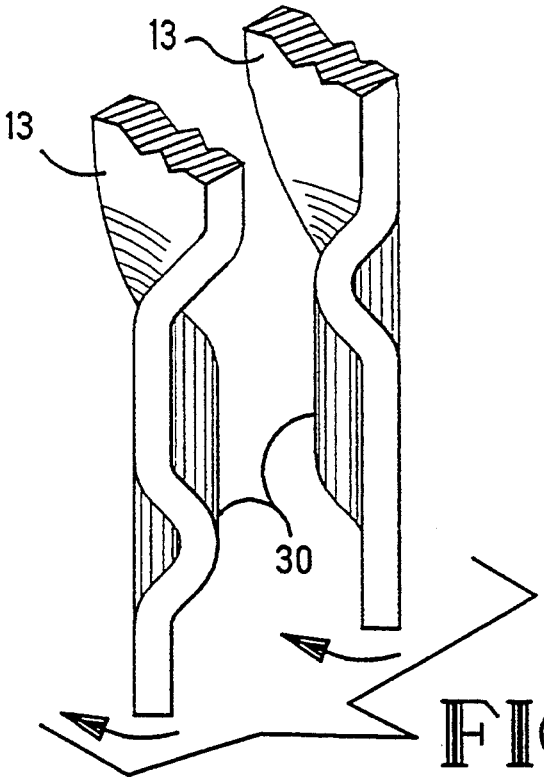
Figure 12D:
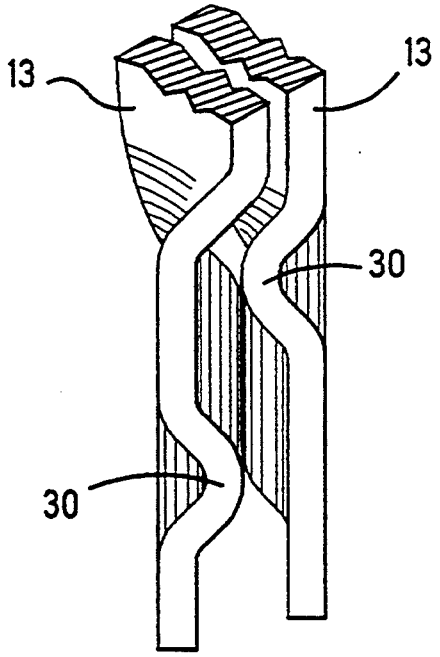
Figure 13A:
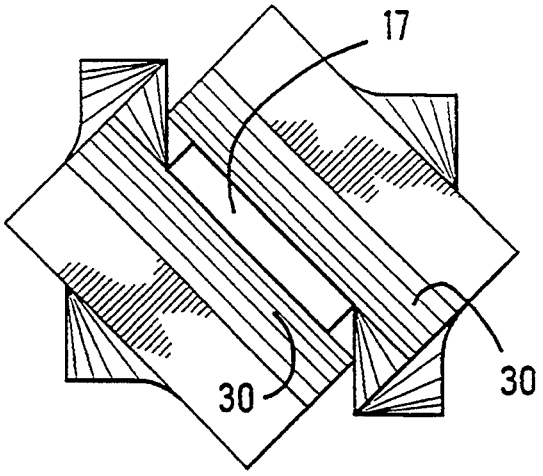
FIG. 13A–13C are end views of the embodiment of FIG. 11 showing the wiping movement of the shorting contacts.
Figure 13B:
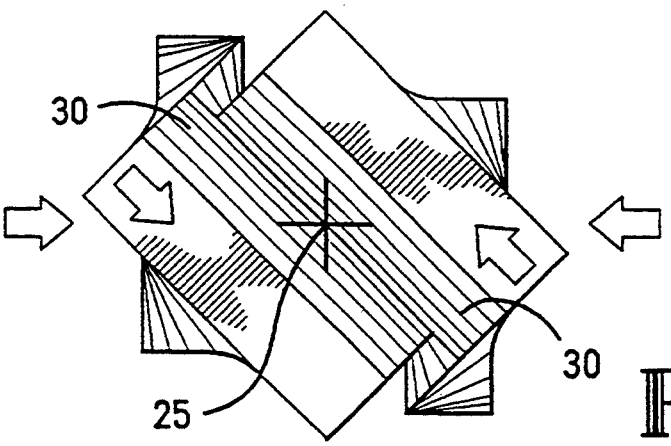
Figure 13C:
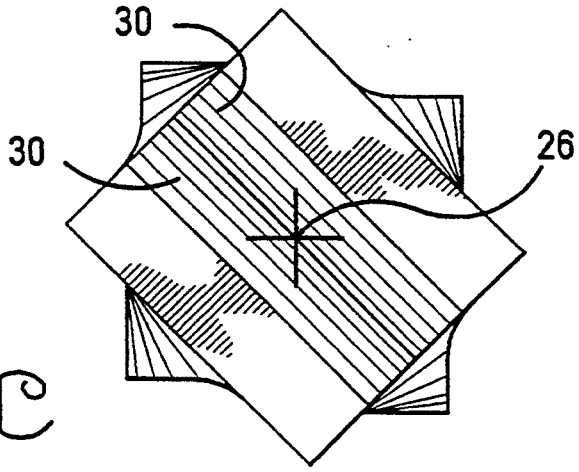
Figure 14:
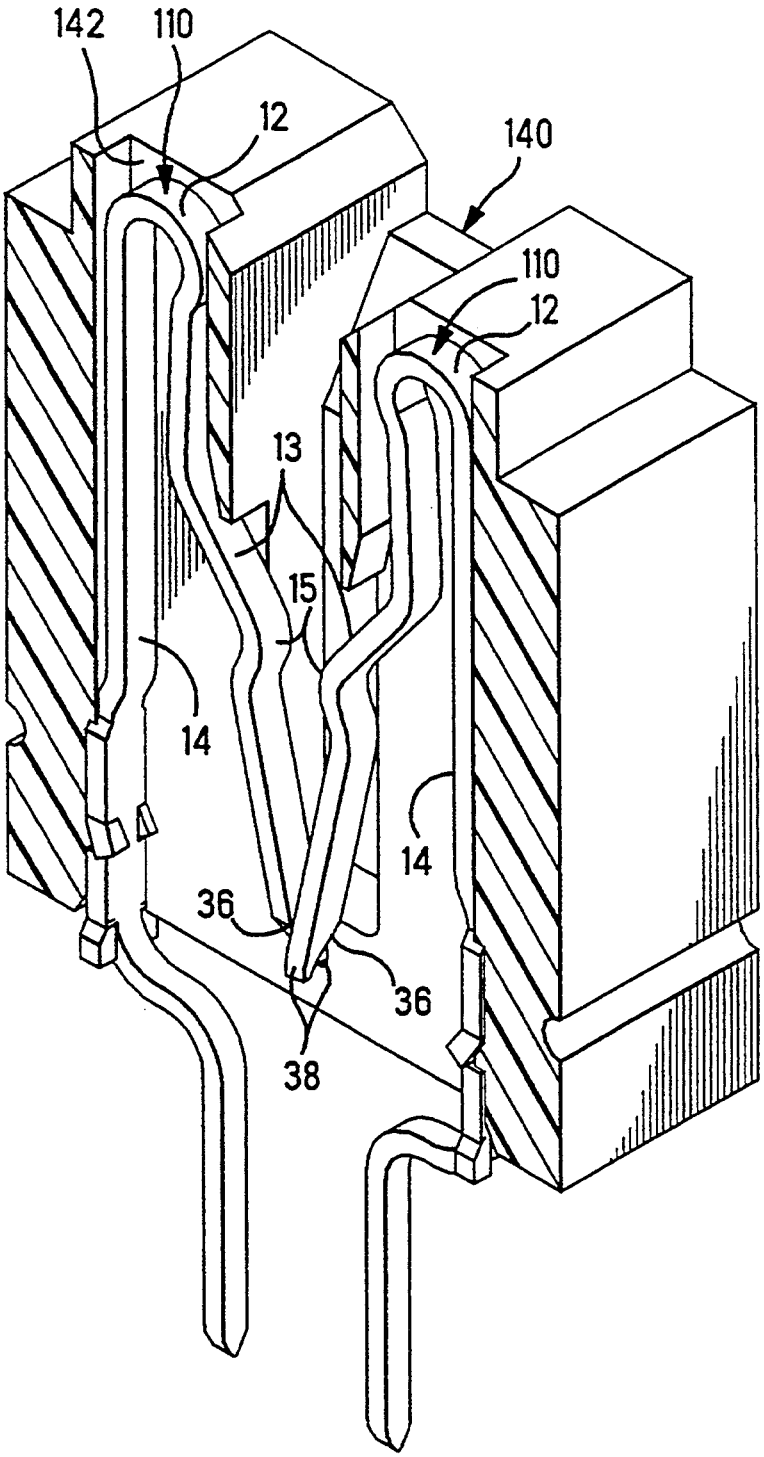
FIG. 14 is a perspective view of a mated pair of electrical terminal members showing the shorting contacts of another embodiment of the present invention.
Figure 16:
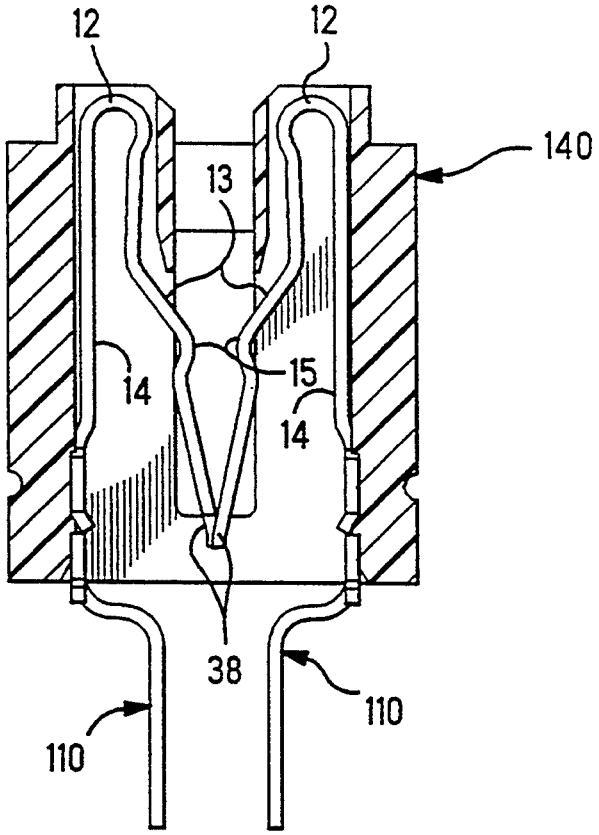
FIG. 16 is a flat plan view of the mated pair of electrical terminal members of FIG. 14.
Figure 17:
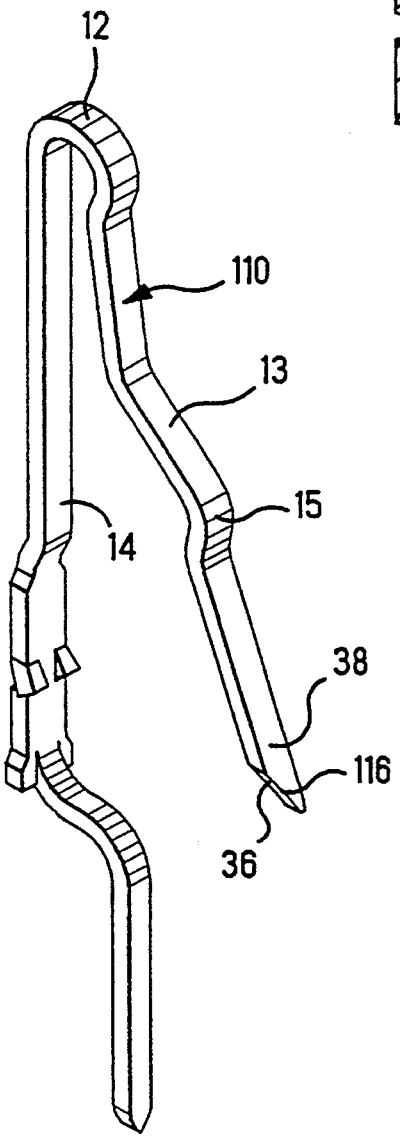
FIG. 17 is a perspective view of one electrical terminal member of FIG. 14 showing the right side of the shorting contact.
Figure 15:
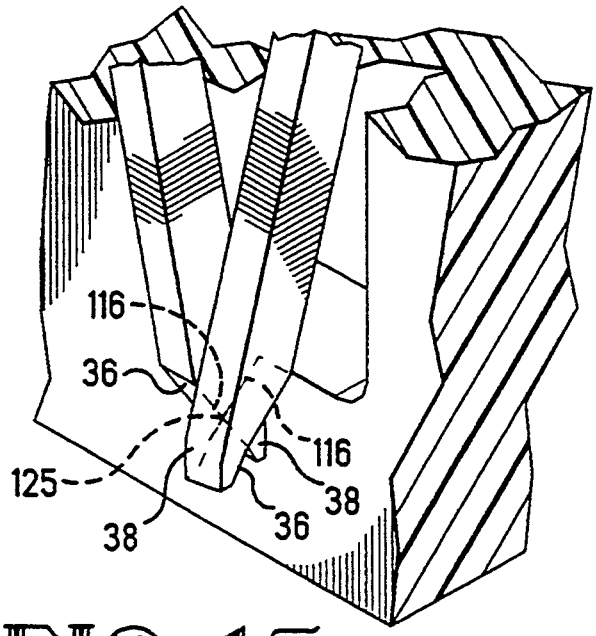
FIG. 15 is an enlarged fragmentary view of the shorting contacts of the embodiment of FIG. 14.

In another embodiment (FIGS. 11–13) the shorting contacts 16 on the respective connecting bodies 10 are formed as a radiused protrusion 30 which is at an acute angle with respect to the longitudinal axis of the front leg 13 of the respective connecting body 10. The method of forming the radiused protrusion 30 is shown in FIGS. 12A–12D. The radiused protrusion 30 is formed in the connecting body at approximately 30°–60° with respect to longitudinal axis and at an especially preferred angle of 45°. The mated opposed electrical terminal member 10 also has a radiused protrusion 30 formed therein, the radiused protrusion being a laterally-reversed mirror image of the opposite and confronting radiused protrusion. In the preferred configuration, where the respective radiused protrusions 30, 30 are disposed at an angle of 45° with respect to the longitudinal axis of the front leg, the radiused protrusions on the mated connecting bodies 10 are at 90° with respect to one another. In order to further improve the reliability of the connection, the respective front legs 13 of the connecting bodies are twisted through approximately 45° so that when the radiused protrusions 30, 30 on the respective bodies 10 contact one another, the angle of the contact is approximately 45°. When the opposing radiused protrusions 30, 30 initially engage one another, there is an initial contact point on the curved edge of each respective protrusion 30. As in the previously described embodiment, the contact point is under high stress and due to the resiliency of the connecting bodies and the arcuate nature of the contacting edges, the protrusions wipe past one another in a sliding moving until the resilient forces equalize and the motion stops at a final contact point. The path between the initial contact point and the final contact point constitutes a line.

A further preferred alternative embodiment is shown in FIGS. 14–17 in which the shorting contacts 116 are provided by stamping or cutting the leading ends 38 of terminal members 110 at an acute angle shown as 36. The acute angle is in the range of 5° to 60° and preferably is approximately 20°. When a pair of terminal members 110 are disposed in respective cavities 142 of connector housing 140, the respective angled surfaces 36 on the terminal men%hers 110 are laterally-reversed mirror images of one another. In this manner the edge 116 of one of the angled surface 36 is disposed opposite edge 116 of the other angled surface 36 and the respective edges 116 confront one another in a transverse configuration. As the respective edges 116 initially contact one another there is an initial contact point 125 on the edge of each terminal member 110. Due to the resiliency of the electrical terminal members 110, and there being only a point contact between the electrical terminal members 110, the contact point 125 is under high stress. Also due to such resiliency and the acute angled nature of the respective contacting edges 116 of the respective terminal men%hers 110, the edges 116 wipe against one another in a sliding movement and come to engage one another at a final contact point, the path between the initial contact point 125 and the final contact point constituting a line. In addition to the increased stress between the edges of the angled surfaces, this embodiment is more cost effective to manufacture because the angled surface can be formed during the process of stamping the terminal members from a strip of metal and the steps to form a protrusion and/or twist the terminal leg can be eliminated.

As will be appreciated by those skilled in the art, the present invention provides features and advantages as follows: (1) contact between opposing shorting contacts is reliable, (2) point contact is made under high stress and (3) a wiping movement between the opposing shorting contacts overcomes film and debris on the contact surfaces.

Obviously, many modifications may be made without departing from the basic spirit of the present invention. Accordingly, it will be appreciated by those skilled in the art that within the scope of the appended claims, the invention may be practical other than has been specifically described herein.

What is claimed is:

1. A pair of shorting contacts for a printed circuit board assembly, comprising a pair of terminal members, each of which has a longitudinal axis, a leading edge on each of the terminal members is provided with an acute angle with respect to the longitudinal axis of the respective terminal member, the terminal members being in a side-by-side relationship so that their respective angled surfaces confront one another substantially in a transverse configuration, wherein the edge of each angled surface is opposite the edge of each confronting angled surface so that the respective sides of the angled surfaces on the terminal members initially engage each other at an initial point contact, thereby providing a very high stress concentration therebetween, and so that the terminal members thereafter wipe against each other and come to engage each other at a final point contact, and such that the path from the initial point contact to the final point contact constitutes a line between the respective terminal members.

2. The shorting contacts of claim 1, wherein the acute angle is in the range of 5° to 60°.

3. The shorting contacts of claim 2, wherein the acute angle is approximately 20°.

* * * * *